United States Patent [19]

Howell

[11] Patent Number: 4,714,807

[45] Date of Patent: Dec. 22, 1987

[54] LOW VOLTAGE VACUUM CIRCUIT INTERRUPTER

[75] Inventor: Edward K. Howell, Simsbury, Conn.

[73] Assignee: General Electric Company, New York, N.Y.

[21] Appl. No.: 21,364

[22] Filed: Mar. 2, 1987

Related U.S. Application Data

[62] Division of Ser. No. 770,931, Aug. 30, 1985, Pat. No. 4,667,071.

[51] Int. Cl.[4] ..... H01H 33/66
[52] U.S. Cl. ..... 200/144 B
[58] Field of Search ..... 200/144 B

[56] References Cited

U.S. PATENT DOCUMENTS

| | | | |
|---|---|---|---|
| 1,814,851 | 7/1931 | Prince | 200/144 B |
| 2,981,813 | 4/1961 | Jennings | 200/144 B |
| 3,040,212 | 6/1962 | Hermann et al. | 200/144 B |

*Primary Examiner*—Robert S. Macon
*Attorney, Agent, or Firm*—Richard A. Menelly; Walter C. Bernkopf; Fred Jacob

[57] ABSTRACT

A solid state switch connected across a pair of separable contacts for eliminating arcing across the contacts allows the contacts and the contact driver to be enclosed within an evacuated envelope. The vacuum environment allows the use of an inexpensive, highly conductive contact material, such as copper, without fear of chemical reaction.

7 Claims, 1 Drawing Figure

LOW VOLTAGE VACUUM CIRCUIT INTERRUPTER

This is a divisional of application Ser. No. 770,931, filed Aug. 30, 1985, now U.S. Pat. No. 4,667,071.

BACKGROUND OF THE INVENTION

The provision of a solid state switch across a pair of separable contacts to reduce arcing between the contacts, when separated, is disclosed within U.S. patent application Ser. No. 610,947 filed May 16, 1984 entitled "Solid State Current Limiting Interrupter" in the name of E. K. Howell. This application is incorporated herein for purposes of reference and should be reviewed for a good description of the circuit components used within the solid state switch.

The absence of an arc between the contacts, when separated, allows smaller contacts which in turn are more readily separated in the early stages of the current waveform to further reduce contact heating and deterioration. U.S. patent application Ser. No. 684,307 filed Dec. 20, 1984 entitled "High Speed Contact Driver For Circuit Interrupter Device" and U.S. patent application Ser. No. 759,710 filed July 29, 1985 entitled "Piezoelectric Contact Driver For Circuit Interrupters", both in the name of E. K. Howell, disclose contact drivers for rapid circuit interruption by means of a pair of fixed contacts and a bridging contact operated by a contact driver. Both these applications are also incorporated herein for purposes of reference. The use of the solid state switch in combination with the high speed contact driver to separate the contacts allows the solid state circuit components to be reduced in rating and hence more economically feasible. U.S. patent application Ser. No. 763,574 filed Aug. 8, 1985 entitled "Change Of State Contact Material For Electric Circuit Interrupters", also in the name of E. K. Howell, describes a contact structure that allows for a reduction in the contact holding force which is required to provide low contact resistance between the contacts. This results in the use of smaller contacts and contact holding springs. This application is incorporated herein for purposes of reference and should be reviewed for a good understanding of the materials and arrangement used to promote these benefits.

By the synergistic combination of a solid state switch, high speed contact driver and change of state electrode materials, the size of the contacts and the means for separating the contacts can be reduced sufficiently to enable containment within an evacuated envelope. The use of the evacuated envelope now allows either the fixed contact pair of the bridging contact to be fabricated from copper metal rather than silver. The copper provides good electrical conduction between the contacts along with a substantial reduction in materials costs. The copper remains oxide-free under the vacuum contained within the sealed envelope as well as when reducing-type gases are employed instead of vacuum.

SUMMARY OF THE INVENTION

A low voltage vacuum interrupter consisting of a pair of fixed contacts and a bridging contact under the control of a high speed contact driver are arranged within an evacuated envelope. The fixed contacts comprise copper metal while the bridging contact comprises a change of state layered metal contact. A solid state switch connected across the fixed contact pair allows the contacts to be separated without the occurrence of any arc whatsoever.

Figure 1:
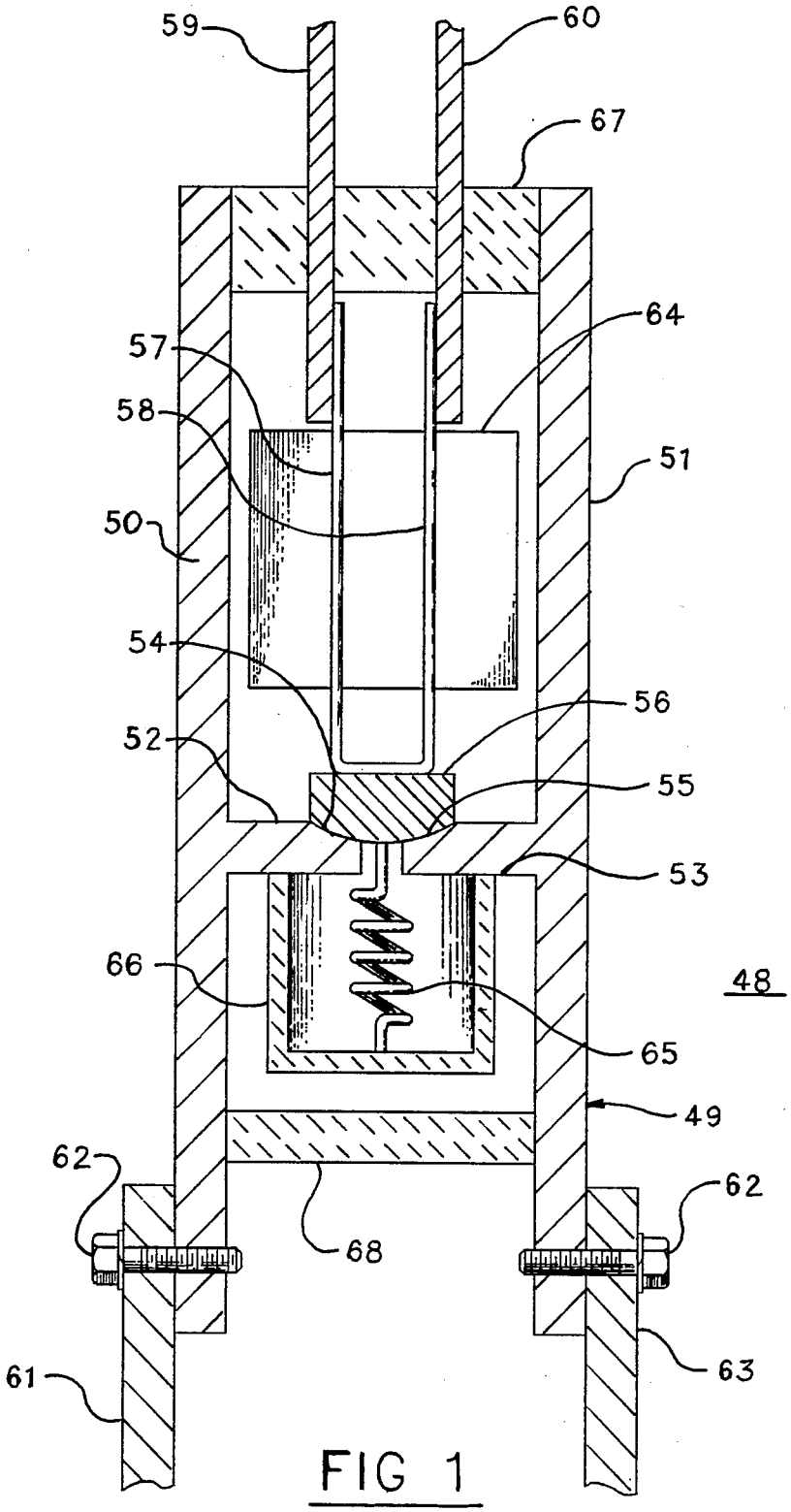
FIG. 1 is a side sectional view of a low voltage vacuum interrupter according to the invention.

A low voltage vacuum interrupter 48 is shown in FIG. 1 to consist of an H-shaped contact configuration 49 consisting of a stepped shaped metal bar 50 with a formed contact 54 arranged at one end of the step 52 integrally formed with the stepped shape metal bar. A second stepped shaped metal bar 51 is arranged opposite the stepped shaped metal bar 50 such that the fixed contact 55 formed at one end of the step 53 is oppositely adjacent the contact 54. A bridging contact 56 is suspended from one end of a pair of closely spaced wires 57, 58 for electrodynamic repulsion when a current pulse is applied to the lead-in wires 59, 60. In a manner similar to the low voltage vacuum interrupter depicted in FIG. 1, a plurality of magnetic plates 64 are arranged on either side of the closely spaced wires to enhance the electrodynamic repulsion. A pair of ceramic endwalls 67, 68 are arranged at opposite ends of the H-shaped contact arrangement 49 to allow for electrical insulation between the lead wires 59, 60. Electrical connection is made with the contacts 54, 55 by means of a separate pair of wires 61, 63 attached to the stepped shaped metal bars 50, 51 by means of screws 62. The bridging contact is held in good electrical connection with contacts 54, 55 by means of a contact spring 65 attached to a U-shaped ceramic support 66. The low voltage vacuum interrupter 48 is hermetically sealed by the provision of a rectangular envelope (not shown) arranged on both sides of the H-shaped contact arrangement 49. The operation of the closely spaced wires 57, 58 to drive the bridging contact 67 out of electrical connection with the contacts 54, 55 is similar to that of the low voltage vacuum interrupter 32 depicted in FIG. 1. It is noted that the electrodes 54, 55 are formed from the same copper material used to fabricate the stepped shaped metal bars 50, 51. The evacuated environment within the low voltage vacuum interrupter allows the use of copper electrodes without fear of oxidation. A small amount of a reducing atmosphere, such as hydrogen gas, can be introduced to the envelope prior to evacuation to further ensure the absence of oxidation over long periods of continued use. The bridging contact 56 can have the components and configuration of the change of state contact material described within the aforementioned U.S. patent application entitled "Change Of State Contact Material For Electric Circuit Interrupters". This ensures good electrical conduction between the bridging contact 56 and the contacts 54, 55 with only a relatively small contact spring 65.

I claim:

1. A vacuum circuit interrupter comprising:

a hermetically sealed closure;

a contact structure within said closure for interrupting current through an external electric circuit;

said contact structure comprising a pair of first and second metal supports, said first support having a first shaped extension in spaced relation to a second shaped extension on said second support, said first and second shaped extensions comprising fixed contacts arranged for electrical connection with a movable bridging contact; and contact separation means within said closure and attached to said bridging contact at one end for driving said bridging contact out of electrical connection with said fixed contacts when an electrical control signal is applied to said separating means;

said contact separation means comprising a pair of spaced parallel wires arranged between a plurality of metal plates for becoming electrodynamically repulsed by said electrical signal to thereby lift said bridging electric contact out of electrical connection with said fixed contact pair.

2. The vacuum circuit interrupter of claim 1 wherein said bridging contact is held in said electrical connection with said fixed contacts by means of a contact spring.

3. The vacuum circuit interrupter of claim 1 including dielectric spacers at opposite ends of said metal supports for setting the separation distance between said fixed contacts.

4. The vacuum circuit interrupter of claim 1 including a pair of electrical lead-in wires connected with said contact separation means for receiving said control signal.

5. The vacuum circuit interrupter of claim 1 wherein one end of each of said metal supports extends outside of said closure for providing electrical connection between said fixed contacts and said electric circuit.

6. The vacuum circuit interrupter of claim 1 wherein said closure is at least partially evacuated for preventing arcing between said bridging contact and said fixed contacts.

7. The vacuum circuit interrupter of claim 1 wherein said closure contains a non-oxidizing gas fill.

* * * * *